US009724922B2

(12) United States Patent
Gengrinovich et al.

(10) Patent No.: US 9,724,922 B2
(45) Date of Patent: Aug. 8, 2017

(54) REMOVE PRINTING FLUID PUDDLES FROM AN EXTERIOR NOZZLE SURFACE OF AN INKJET PRINTHEAD

(71) Applicant: Hewlett-Packard Development Company, L.P., Houston, TX (US)

(72) Inventors: Semion Gengrinovich, Ramat Gan (IL); Harel Malka, Netanya (IL); Alexander Markman, Netanya (IL)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/787,390

(22) PCT Filed: Jul. 29, 2013

(86) PCT No.: PCT/US2013/052513

§ 371 (c)(1),
(2) Date: Oct. 27, 2015

(87) PCT Pub. No.: WO2015/016809

PCT Pub. Date: Feb. 5, 2015

(65) Prior Publication Data

US 2016/0067971 A1 Mar. 10, 2016

(51) Int. Cl.

| | |
|---|---|
| ***B41J 29/38*** | (2006.01) |
| ***B41J 2/165*** | (2006.01) |
| ***B41J 2/045*** | (2006.01) |

(52) U.S. Cl.

CPC ..... *B41J 2/1652* (2013.01); *B41J 2/04581* (2013.01); *B41J 2/04596* (2013.01); *B41J 2/16517* (2013.01); *B41J 2/16526* (2013.01)

(58) Field of Classification Search
None
See application file for complete search history.

(56) References Cited

U.S. PATENT DOCUMENTS

| | | | |
|---|---|---|---|
| 6,513,904 B1 | 2/2003 | Taylor et al. | |
| 6,672,704 B2 | 1/2004 | Katakura et al. | |

(Continued)

FOREIGN PATENT DOCUMENTS

| | | | |
|---|---|---|---|
| JP | 8281939 A | * 10/1996 | ..... B41J 2/045 |
| JP | 2010042592 A | 2/2010 | |

OTHER PUBLICATIONS

International Search Report and Written Opinion dated Apr. 18, 2014, PCT Patent Application No. PCT/US2013/052513 dated Jul. 29, 2013 , Korean Intellectual Office.

*Primary Examiner* — Erica Lin
(74) *Attorney, Agent, or Firm* — HP Inc.—Patent Department

(57) ABSTRACT

A method of removing printing fluid puddles from an exterior nozzle surface of an inkjet printhead includes selectively applying a suction signal for a first time period to a plurality of actuators associated with fluid channels of corresponding nozzles by a control module. The method also includes moving printing fluid within the fluid channels associated with the actuators in response to application of the suction signal. Additionally, the method also includes creating suction in each one of the associated fluid channels and through the corresponding nozzles to remove the printing fluid puddles from the exterior nozzle surface by pulling the printing fluid puddles through the corresponding nozzles and the associated fluid channels in response to movement of the printing fluid within the fluid channels.

12 Claims, 6 Drawing Sheets

(56) References Cited

U.S. PATENT DOCUMENTS

| | | | | |
|---|---|---|---|---|
| 2007/0008356 | A1* | 1/2007 | Katoh | B41J 2/04581 347/10 |
| 2008/0150975 | A1 | 6/2008 | Ueno et al. | |
| 2008/0186352 | A1 | 8/2008 | Sasayama | |
| 2010/0110127 | A1* | 5/2010 | Fukuda | B41J 2/04516 347/10 |
| 2010/0231634 | A1 | 9/2010 | Yokota et al. | |
| 2012/0105539 | A1 | 5/2012 | Kimura et al. | |
| 2012/0229542 | A1 | 9/2012 | Kida | |
| 2012/0229579 | A1 | 9/2012 | Kushida et al. | |
| 2012/0262512 | A1* | 10/2012 | Oshima | B41J 2/04541 347/10 |

* cited by examiner

REMOVE PRINTING FLUID PUDDLES FROM AN EXTERIOR NOZZLE SURFACE OF AN INKJET PRINTHEAD

CLAIM FOR PRIORITY

The present application is a national stage filing under 35 U.S.C. §371 of PCT application number PCT/US2013/052513, having an international filing date of Jul. 29, 2013, the disclosure of which is hereby incorporated by reference in its entirety.

BACKGROUND

Inkjet printing systems may include inkjet printheads including a plurality of fluid channels having nozzles to eject drops of printing fluid there from during a firing state. For example, the printing fluid may be selectively ejected from the fluid channels, through the nozzles, and onto a substrate in the form of drops to form images thereon. Periodically, during the firing state, printing fluid puddles may accumulate on an exterior nozzle surface of the respective inkjet printhead.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

An inkjet printing system may include an inkjet printhead including a plurality of fluid channels having nozzles to eject drops of printing fluid (e.g., printing fluid drops) there from during a firing state. Printing fluid may accumulate as printing fluid puddles on an exterior nozzle surface of the inkjet printhead overtime, for example, due to the firing and spitting of the inkjet printhead. Surface tension between the printing fluid puddles and the exterior nozzle surface may influence the puddles to remain thereon for an extended period. Subsequently, the puddles may dry out and form a residue layer on the exterior nozzle surface that may obstruct the nozzles. Consequently, image degradation, printhead damage, and a reduction in throughput of the inkjet printing system may be increased.

In examples, a method of removing printing fluid puddles from an exterior nozzle surface of an inkjet printhead includes selectively applying a suction signal for a first time period to a plurality of actuators associated with fluid channels of corresponding nozzles by a control module. The method also includes moving printing fluid within the fluid channels associated with the actuators in response to an application of the suction signal. Additionally, the method also includes creating suction in each one of the associated fluid channels and through the corresponding nozzles to remove the printing fluid puddles from the exterior nozzle surface by pulling the printing fluid puddles through the corresponding nozzles and into the associated fluid channels in response to movement of the printing fluid within the fluid channels. Thus, the suction produced in the fluid channels and through the corresponding nozzles may remove (e.g., pull) unwanted, printing fluid puddles from the exterior nozzle surface and into the nozzles and fluid channels. Accordingly, the removal of printing fluid puddles from the exterior nozzle surface through the creation of suction may reduce image degradation, printhead damage, and a reduction in throughput of the inkjet printing system.

Figure 1:
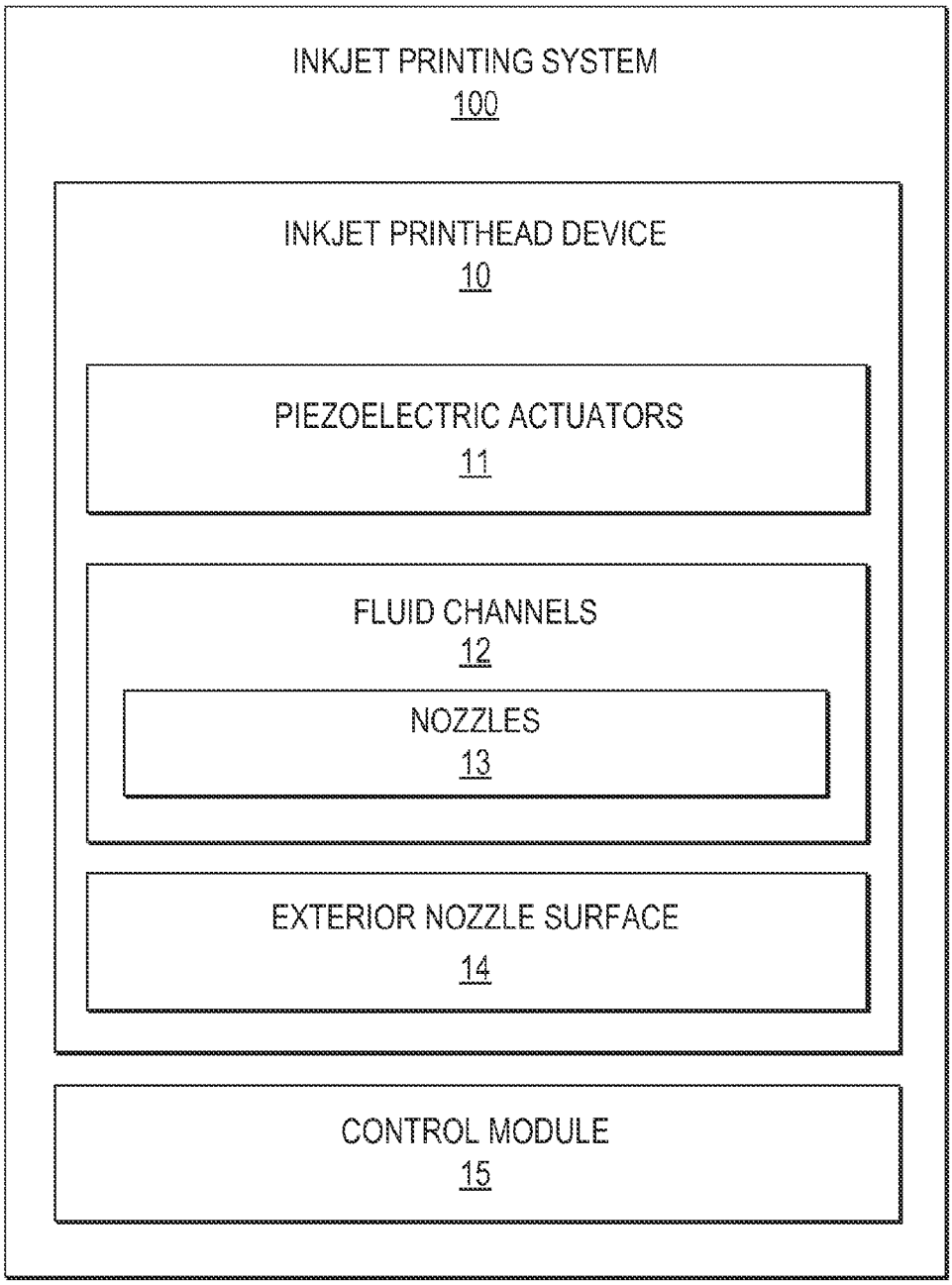
FIG. 1 is a block diagram illustrating an inkjet printing system according to an example.

FIG. 1 is a block diagram illustrating an inkjet printing system according to an example. Referring to FIG. 1, in some examples, an inkjet printing system 100 includes an inkjet printhead 10 and a control module 15 according to an example. The inkjet printhead 10 may include a plurality of piezoelectric actuators 11, a plurality of fluid channels 12 associated with the piezoelectric actuators 11, a plurality of nozzles 13 corresponding to the fluid channels 12, and an exterior nozzle surface 14 having an arrangement of the nozzles 13 thereon. For example, in a firing state, the piezoelectric actuators 11 may receive a firing signal to cause sufficient movement of the piezoelectric actuators 11 to provide sufficient pressure to the printing fluid in the respective fluid channels 12 to eject the printing fluid through corresponding nozzles 13 to a substrate, and the like. Periodically, puddles of printing fluid (e.g., printing fluid puddles) may form on the exterior nozzle surface 14. Such puddles may dry out and obstruct the nozzles 13.

Referring to FIG. 1, in some examples, the control module 15 may selectively apply a suction signal for a first period of time (e.g., first time period $tp_1$) to the plurality of piezoelectric actuators 11 associated with fluid channels 12 of corresponding nozzles 13. That is, the piezoelectric actuators 11 may move in response to receiving the suction signal to move printing fluid within the fluid channels 12 associated with the piezoelectric actuators 11 to create suction in each one of the associated fluid channels 12 and through the corresponding nozzles 13. For example, the suction signal may be in a form to cause repetitive movement such as retraction and expansion of respective piezoelectric elements of the respective piezoelectric actuators 11 (e.g., tickling) to cause negative pressure in the respective fluid channels 12 resulting in suction therein and insufficient pressure to eject printing fluid drops there from. The application of a signal to the piezoelectric actuators to cause an amount of movement thereof resulting in a non-jetting of printing fluid drops from nozzles of the inkjet printhead may be referred to as tickling.

Referring to FIG. 1, in some examples, the suction created in the associated fluid channels 12 and through the corresponding nozzles 13 may be sufficient enough to pull printing fluid puddles from the exterior nozzle surface 14 into the nozzles 13 and respective fluid channels 12. Such suction created by the tickling, for example, may create an additional negative pressure, for example, that may be combined with a back pressure. Back pressure, for example, may be provided by a back pressure regulator (not illustrated) to reduce drooling of printing fluid through the nozzles 13. The application of the suction signal to the piezoelectric actuators 11 does not result in ejection of the printing fluid from the nozzles 13. That is, the suction signal corresponding to tickling does not create a type of pressure of sufficient strength to cause printing fluid drops to fire from the nozzles 13.

Figure 2A:
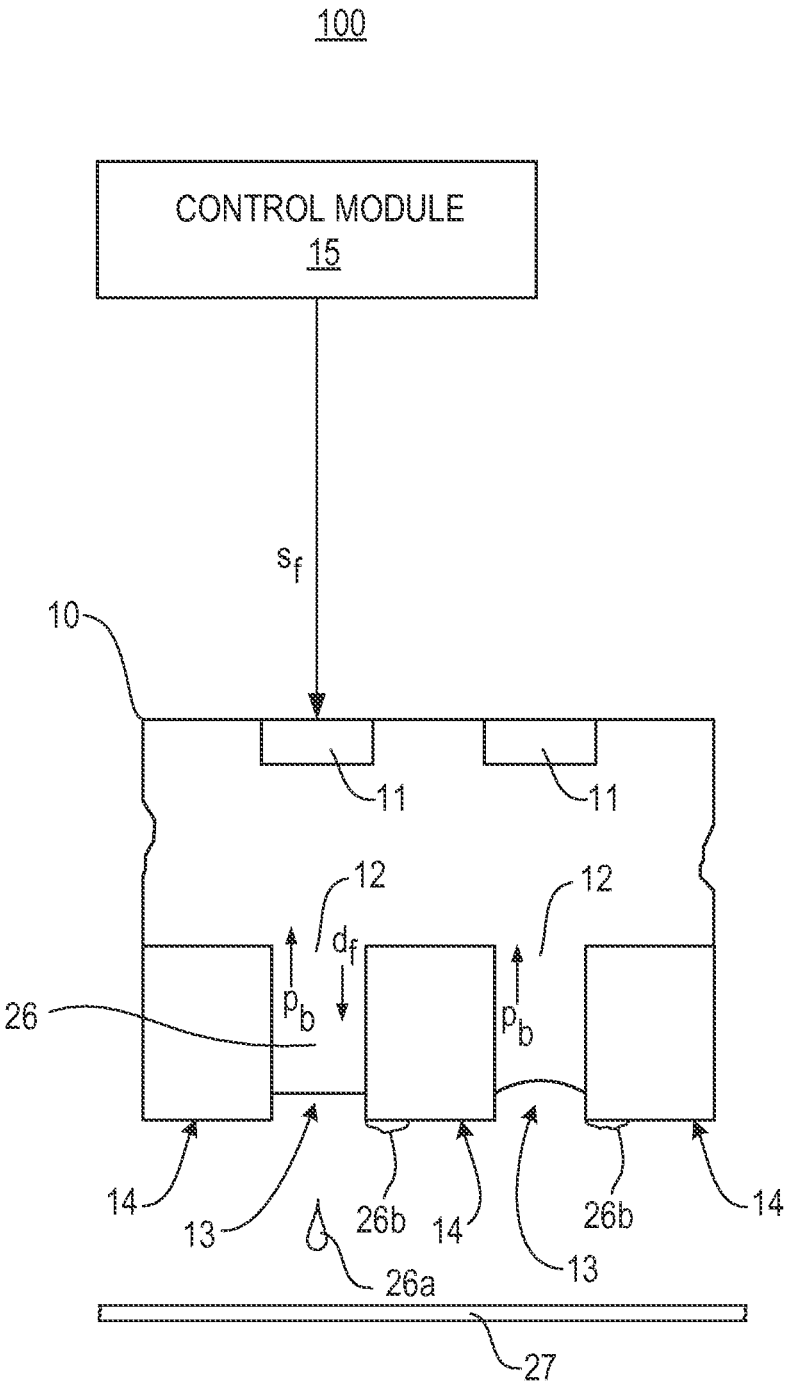
FIGS. 2A, 2B and 2C are schematic views illustrating an inkjet printhead of the inkjet printing system of FIG. 1 in a firing state, a spitting state, and a suction state, respectively, according to examples.
Figure 2B:
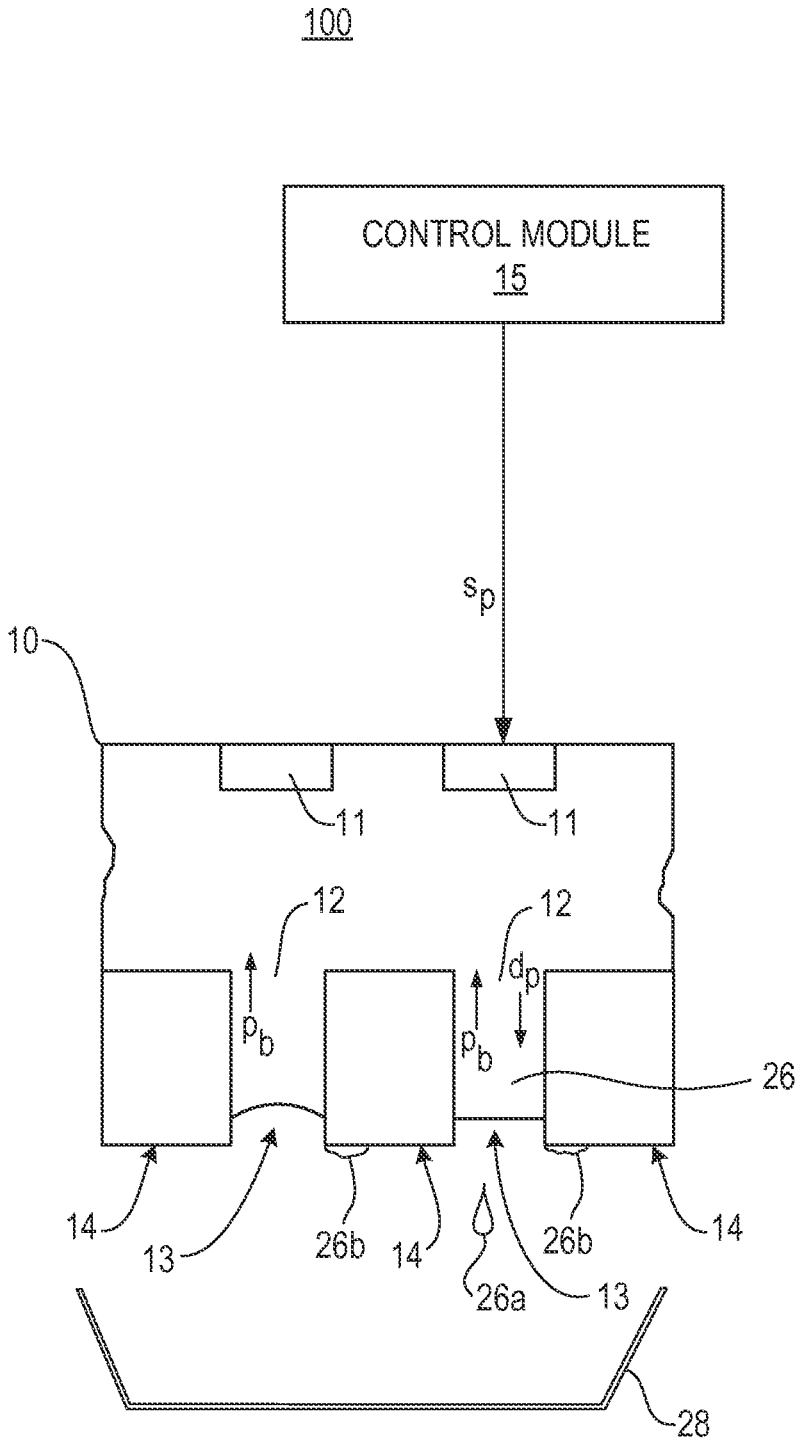
Figure 2C:
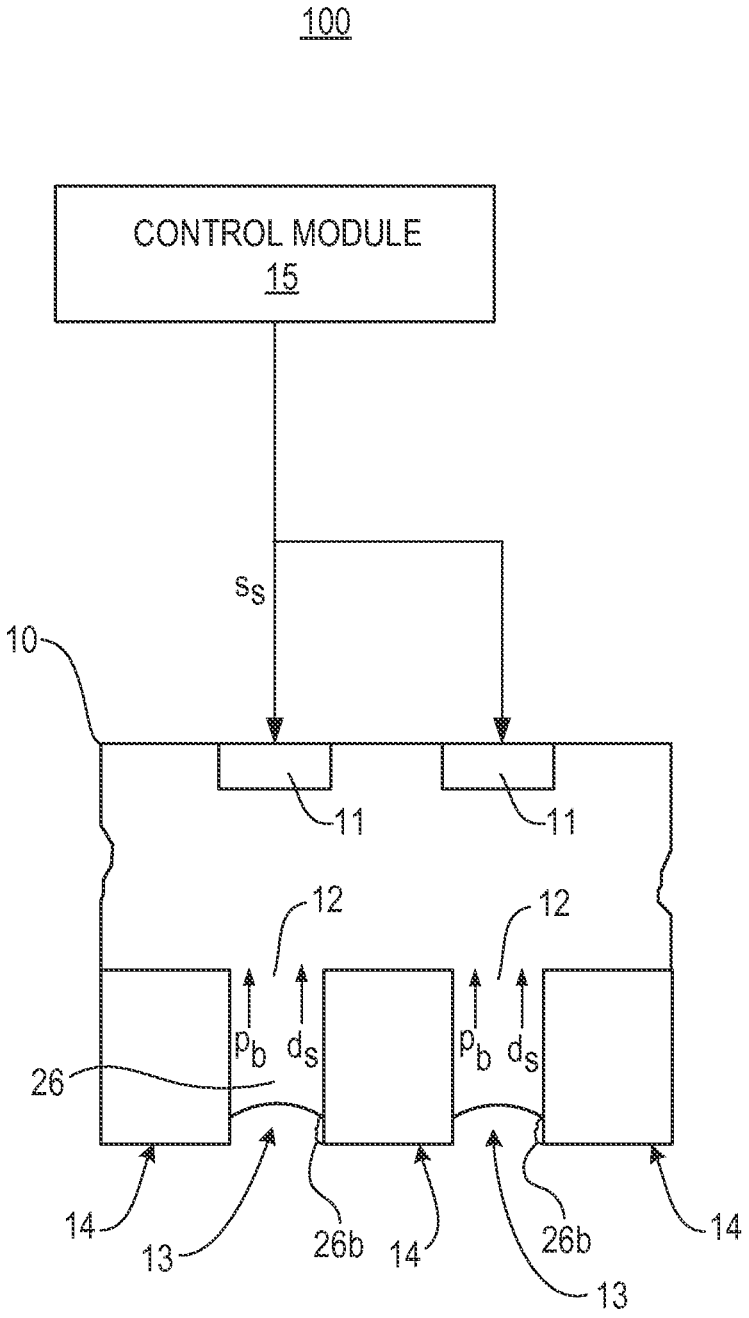
Figure 3A:
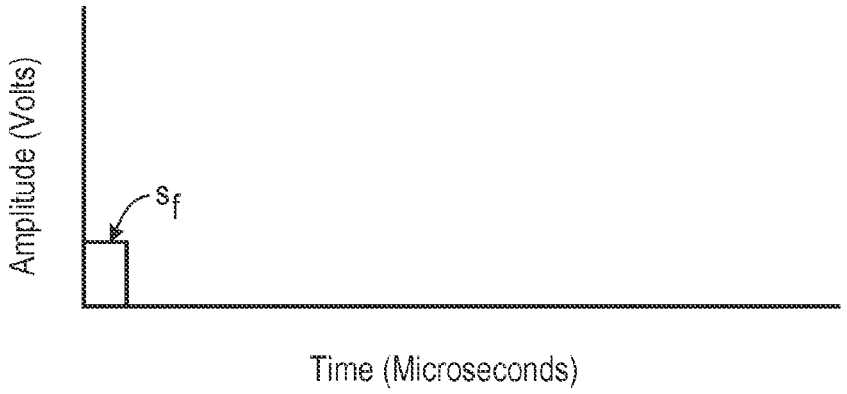
FIGS. 3A, 3B, and 3C are graphs illustrating a firing signal, a spitting signal, and a suction signal applied by a control module of the inkjet printing system of FIG. 1, respectively, according to examples.
Figure 3B:
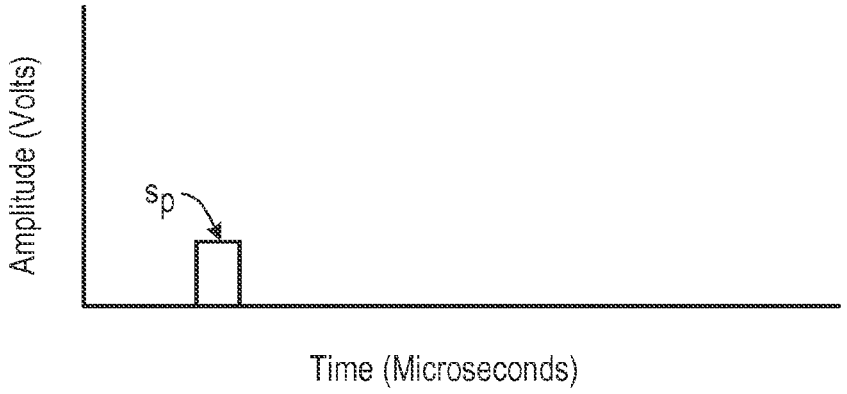
Figure 3C:
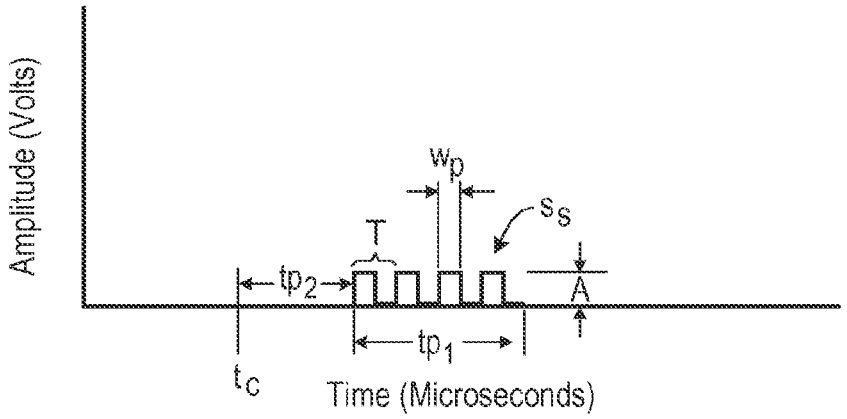

FIGS. 2A, 2B and 2C are schematic views illustrating an inkjet printhead of the inkjet printing system of FIG. 1 in a firing state, a spitting state, and a suction state, respectively, according to examples. FIGS. 3A, 3B, and 3C are graphs illustrating a firing signal, a spitting signal, and a suction signal applied by a control module of the inkjet printing system of FIG. 1, respectively, according to examples. Referring to FIGS. 2A-3C, in some examples, the inkjet printing system 100 may include the plurality of piezoelectric actuators 11, the plurality of fluid channels 12 associated with the piezoelectric actuators 11, the plurality of nozzles 13 corresponding to the fluid channels 12, and the exterior nozzle surface 14 as previously discussed with respect to FIG. 1.

Referring to FIGS. 2A-3C, in some examples, the inkjet printing system 100 may be in a firing state, a spitting state, and a suction state. In each of the states, for example, the inkjet printhead 10 may include back pressure $p_b$ to reduce drooling of printing fluid 26 out of the nozzles 13. That is, a back pressure regulator (not illustrated) may provide an amount of negative pressure to the fluid channels 12 to reduce unwanted flow of printing fluid 26 out of the nozzles 13.

Referring to FIGS. 2A and 3A, in the firing state, for example, the control module 15 may selectively apply a firing signal $s_f$ to a respective piezoelectric actuator 11 to cause a printing fluid drop 26*a* to eject from the respective nozzle 13 corresponding to the respective piezoelectric actuator 11, for example, to form an image on a substrate 27. That is, the firing signal $s_f$ may include sufficient amplitude A to provide adequate movement of a piezoelectric element of the respective piezoelectric actuator 11 to provide a sufficient amount of pressure $d_f$ in the corresponding fluid channel 12.

Referring to FIGS. 2A and 3A, in the firing state, the sufficient amount of pressure $d_f$ causes printing fluid 26 in the fluid channel 12 to be ejected from the respective nozzle 13 in a form of a printing fluid drop 26*a*. The printing fluid drop 26*a*, for example, may be directed towards a substrate 27 to form an image thereon. During the firing of the printing fluid drop 26*a*, printing fluid may accumulate overtime in a form of printing fluid puddles 26*b* on the exterior nozzle surface 14. Surface tension between the printing fluid puddles 26*b* and the exterior nozzle surface 14 may influence the printing fluid puddles 26*b* to remain on the exterior nozzle surface for an extended period of time. Subsequently, the printing fluid puddles 26*b* may dry out and form a residue layer on the exterior nozzle surface 14 that may obstruct the nozzles 13.

Referring to FIGS. 2B and 3B, in the spitting state, for example, the control module 15 may selectively apply a spitting signal $s_p$ to a respective piezoelectric actuator 11 to cause a printing fluid drop 26*a* to eject from a respective nozzle 13 corresponding to the respective piezoelectric actuator 11, for example, into a service station 28 such as a spittoon, and the like. That is, the spitting signal $s_p$ may be of sufficient amplitude to provide adequate movement of the piezoelectric element of the respective piezoelectric actuator 11 to provide a sufficient amount of pressure $d_p$ in the corresponding fluid channel 12.

Referring to FIGS. 2B and 3B, in the spitting state, the sufficient amount of pressure $d_p$ causes printing fluid 26 in the fluid channel 12 to be ejected from the respective nozzle 13 in a form of a printing fluid drop 26*a*. The printing fluid drop 26*a*, for example, may be directed towards the service station 28. The spitting state may occur periodically to provide wetting of the nozzles 13. In some examples, the control module 15 may also selectively apply spitting signals to the plurality of piezoelectric actuators 11 to refresh the associated fluid channels 12 and the corresponding nozzles 13. During the spitting state of the printing fluid drops 26*a*, printing fluid may accumulate overtime in a form of printing fluid puddles 26*b* on the exterior nozzle surface 14. Surface tension between the printing fluid puddles 26*b* and the exterior nozzle surface 14 may influence the printing fluid puddles 26*b* to remain on the exterior nozzle surface 14 for an extended period of time. Subsequently, the printing fluid puddles 26*b* may dry out and form a residue layer on the exterior nozzle surface 14 that may obstruct the nozzles 13. In some examples, the fluid channels 12 and nozzles 13 may be purged, for example, by a purging module (not illustrated) of the printing apparatus 200.

Referring to FIGS. 2C and 3C, in some examples, the control module 15 may also selectively apply a suction signal $s_s$ for a first time period $tp_1$ to the plurality of piezoelectric actuators 11 associated with fluid channels 12 of corresponding nozzles 13 to move printing fluid 26 within the fluid channels 12 associated with the piezoelectric actuators 11. Such movement may create suction in each one of the associated fluid channels 12 and through the corresponding nozzles 13 to remove printing fluid puddles 26*b* from the exterior nozzle surface 14 by pulling the printing fluid puddles 26*b* through the corresponding nozzles 13 and into the associated fluid channels 12. In some examples, the first time period $tp_1$ may be in a first time period range of over four seconds. For example, the first time period $tp_1$ may be in a first time period range of four to ten seconds. The application of the suction signal $s_s$ to the piezoelectric actuators 11 may not result in ejection of the printing fluid 26 from the nozzles 13. That is, the suction signal $s_s$ does not create a type of pressure of sufficient strength to cause printing fluid drops 26*a* to fire from the nozzles 13.

Referring to FIGS. 2C and 3C, in some examples, the suction signal $s_s$ is a pulse width modulation signal. For example, the pulse width modulation signal may include a pulse width $w_p$ within a pulse width range of 0.5 to 12 microseconds, an amplitude A in an amplitude range of 23 to 42 volts, and a frequency in a frequency range of 1 to 35 kilohertz. The frequency may be equal to the reciprocal (1/T) of the period T. The period T may correspond to a duration of one cycle of a repeating event. In particular, the pulse width modulation signal may include the pulse width $w_p$ within the pulse width range of 1.5 to 3 microseconds, the amplitude A in the amplitude range of 23 to 27 volts, and the frequency in the frequency range of 5 to 14 kilohertz.

Referring to FIGS. 2C and 3C, in some examples, the control module 15 may selectively apply the suction signal $s_s$ for the first time period $tp_1$ to the plurality of piezoelectric actuators 11 associated with the fluid channels 12 of the corresponding nozzles 13 after a second period of time (e.g., second time period $tp_2$) from completion of at least one of the firing signals $s_f$ and the spitting signals $s_p$ selectively applied by the control module 15. That is, the suction signal $s_p$ may be of sufficient amplitude A to provide an adequate type of movement of the piezoelectric elements of the respective piezoelectric actuators 11 to provide sufficient amount of suction $d_s$ (e.g. negative pressure) in the corresponding fluid channels 12. In FIG. 3C, a respective time $t_c$ in which a respective spitting signal $s_p$ is completed is illustrated.

Consequently, through tickling, a sufficient amount of suction may be created in each one of the associated fluid channels 12 and through the corresponding nozzles 13 to pull (e.g., remove) printing fluid puddles 26*b* from the exterior nozzle surface 14 therein. In some examples, the sufficient amount of suction $d_s$ may be combined with the existing amount of back pressure to enable pulling of the printing fluid puddles 26*a* from the exterior nozzle surface 14. The suction state may occur periodically to remove printing fluid puddles 26*b* from the exterior nozzle surface 14. In some examples, the second time period $tp_2$ may be in a range of 1 to 2 microseconds.

In some examples, the control module 15 may be implemented in hardware, software including firmware, or combinations thereof. The firmware, for example, may be stored in memory and executed by a suitable instruction-execution system. If implemented in hardware, as in an alternative example, the control module 15 may be implemented with any or a combination of technologies which are well known in the art (for example, discrete-logic circuits, application-specific integrated circuits (ASICs), programmable-gate arrays (PGAs), field-programmable gate arrays (FPGAs)), and/or other later developed technologies. In other examples, the control module 15 may be implemented in a combination of software and data executed and stored under the control of a computing device.

Figure 4:
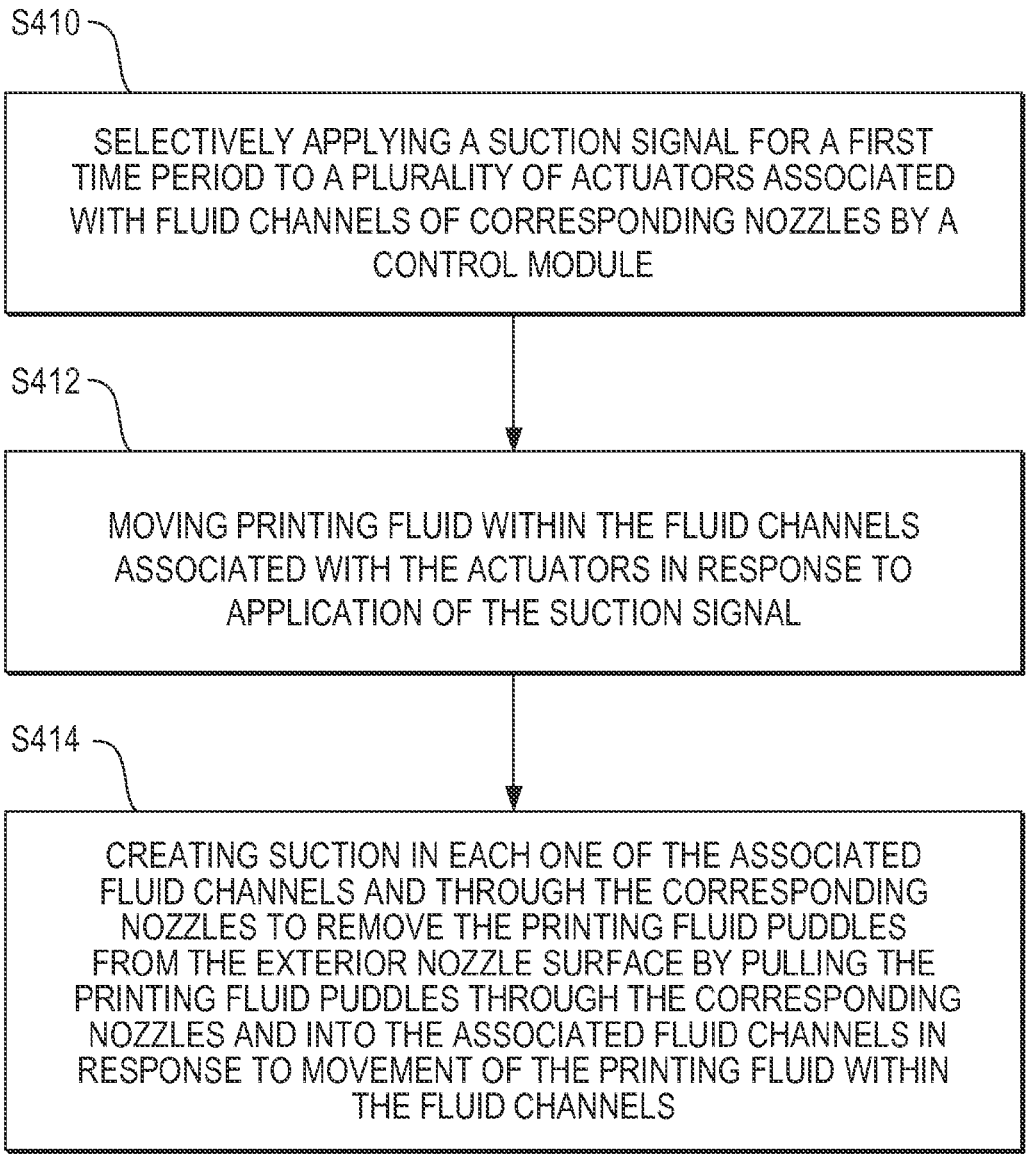
FIG. 4 is a flowchart illustrating a method of removing printing fluid puddles from an exterior nozzle surface of an inkjet printhead according to an example.

FIG. 4 is a flowchart illustrating a method of removing printing fluid puddles from an exterior nozzle surface of an inkjet printhead according to an example. In some examples, the modules, assemblies, and the like, previously discussed with respect to FIGS. 1-3C may be used to implement the detection method of FIG. 4. Referring to FIG. 4, in block S410, a suction signal is selectively applied for a first time period to a plurality of actuators associated with fluid channels of corresponding nozzles by a control module. Additionally, the selectively applying the suction signal for the first time period to the plurality of actuators does not result in an ejection of drops of the printing fluid drops from the nozzles. The suction, for example, may be produced through tickling implemented through application of a pulse width modulation signal.

In some examples, selectively applying the suction signal for the first time period to the plurality of actuators associated with the fluid channels of the corresponding nozzles by the control module may be performed after a second time period $tp_2$ from completion of at least one of the selectively applying the firing signals and the selectively applying the spitting signals. In some examples, the plurality of actuators may include a plurality of piezoelectric actuators. The piezoelectric actuator may include a piezoelectric element which moves in response to an electrical signal applied thereto.

In some examples, the suction signal is a pulse width modulation signal. For example, the pulse width modulation signal may include a pulse width within a pulse width range of 0.5 to 12 microseconds, an amplitude in an amplitude range of 23 to 42 volts, and a frequency in a frequency range of 1 to 35 kilohertz. In particular, the pulse width modulation signal may include the pulse width within the pulse width range of 1.5 to 3 microseconds, the amplitude in the amplitude range of 23 to 27 volts, and the frequency in the frequency range of 5 to 14 kilohertz.

In block S412, printing fluid within the fluid channels associated with the actuators is moved in response to application of the suction signal. In block S414, suction is created in each one of the associated fluid channels and through the corresponding nozzles to remove the printing fluid puddles from the exterior nozzle surface by pulling the printing fluid puddles through the corresponding nozzles and into the associated fluid channels in response to movement of the printing fluid within the fluid channels. In some examples, the method may also include selectively applying firing signals by the control module to respective actuators to cause printing fluid drops to eject from respective nozzles corresponding to the respective actuators to form an image on a substrate. Additionally, the method may also include selectively applying spitting signals to the plurality of actuators to refresh the associated fluid channels and the corresponding nozzles.

It is to be understood that the flowchart of FIG. 4 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 4 illustrates a specific order of execution, the order of execution may differ from that which is depicted. For example, the order of execution of two or more blocks may be rearranged relative to the order illustrated. Also, two or more blocks illustrated in succession in FIG. 4 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A method of removing printing fluid puddles from an exterior nozzle surface of an inkjet printhead, the method comprising:

selectively applying a suction signal for a first time period to a plurality of actuators associated with fluid channels of corresponding nozzles by a control module, wherein the suction signal is a pulse width modulation signal having an amplitude value and a pulse width value, wherein the selective application of the suction signal is to move printing fluid within the fluid channels associated with the actuator, wherein movement of the printing fluid in the fluid channels is to create suction in each one of the associated fluid channels and through the corresponding nozzles to remove the printing fluid puddles from the exterior nozzle surface by pulling the printing fluid puddles through the corresponding nozzles and the associated fluid channels, wherein the pulse width modulation signal has a pulse width value within a pulse width range of 0.5 to 12 microseconds, an amplitude value in an amplitude range of 23 to 42 volts, and a frequency in a frequency range of 1 to 35 kilohertz.

2. The method of claim 1, wherein the first time period is in a first time period range of at least four seconds.

3. The method of claim 1, wherein the selectively applying the suction signal for the first time period to the plurality of actuators does not result in an ejection of printing fluid drops from the nozzles.

4. The method of claim 1, further comprising:

selectively applying firing signals by the control module to respective actuators to cause printing fluid drops to eject from respective nozzles corresponding to the respective actuators to form an image on a substrate, wherein selectively applying the suction signal further comprises selectively applying the suction signal following completion of the selective application of the firing signals.

5. The method of claim 4, further comprising:

selectively applying spitting signals to the plurality of actuators to refresh the associated fluid channels and the corresponding nozzles, wherein selectively applying the suction signal further comprises selectively applying the suction signal following completion of the selective application of the spitting signals.

6. The method of claim 5, wherein the selectively applying the suction signal for the first time period to the plurality of actuators associated with the fluid channels of the corresponding nozzles by the control module is performed after a second time period from completion of at least one of the selectively applying the firing signals and the selectively applying the spitting signals, and wherein the firing signals and the spitting signals are pulse width modulation signals having larger amplitudes and pulse widths than the suction signal.

7. The method of claim 1, wherein the plurality of actuators includes a plurality of piezoelectric actuators.

8. An inkjet printing system, comprising:

an inkjet printhead including a plurality of piezoelectric actuators, a plurality of fluid channels associated with the piezoelectric actuators, a plurality of nozzles corresponding to the fluid channels, and an exterior nozzle surface having an arrangement of the nozzles thereon; and a control module to selectively apply a suction signal for a first time period to the plurality of piezoelectric actuators associated with fluid channels of corresponding nozzles to move printing fluid within the fluid channels associated with the piezoelectric actuators to create a suction force in each one of the associated fluid channels and through the corresponding nozzles to remove printing fluid puddles from the exterior nozzle surface by pulling the printing fluid puddles through the corresponding nozzles and the associated fluid channel, wherein the suction signal is a pulse width modulation signal having an amplitude value and a pulse width value, and wherein the pulse width modulation signal includes a pulse width value within a pulse width range of 0.5 to 12 microseconds, an amplitude value in an amplitude range of 23 to 42 volts, and a frequency in a frequency range of 1 to 35 kilohertz.

9. The inkjet printing system of claim 8, wherein the first time period is in a first time period range of at least four seconds.

10. The inkjet printing system of claim 8, wherein application of the suction signal to the plurality of actuators does not result in an ejection of printing fluid drops from the nozzles.

11. The inkjet printing system of claim 8, wherein the control module is to selectively apply firing signals to respective piezoelectric actuators to cause printing fluid drops to eject from respective nozzles corresponding to the respective piezoelectric actuators to form an image on a substrate, and to selectively apply spitting signals to the plurality of piezoelectric actuators to refresh the associated fluid channels and the corresponding nozzles.

12. The inkjet printing system of claim 11, wherein the control module is to selectively apply the suction signal for the first time period to the plurality of piezoelectric actuators associated with the fluid channels of the corresponding nozzles by the control module after a second time period from completion from at least one of the firing signals and the spitting signals selectively applied by the control module, and wherein the firing signals and the spitting signals are pulse width modulation signals having larger amplitudes and pulse widths than the suction signal.

* * * * *